US009673499B2

(12) United States Patent
Shaman et al.

(10) Patent No.: US 9,673,499 B2
(45) Date of Patent: Jun. 6, 2017

(54) NOTCH FILTER WITH ARROW-SHAPED EMBEDDED OPEN-CIRCUITED STUB

(71) Applicant: King Abdulaziz City for Science and Technology, Riyadh (SA)

(72) Inventors: Hussein Nasser Shaman, Riyadh (SA); Abdulrahman Saad Alarifi, Riyadh (SA)

(73) Assignee: KING ABDULAZIZ CITY FOR SCIENCE AND TECHNOLOGY, Riyadh (SA)

( * ) Notice: Subject to any disclaimer, the term of this patent is extended or adjusted under 35 U.S.C. 154(b) by 40 days.

(21) Appl. No.: 14/838,926

(22) Filed: Aug. 28, 2015

(65) Prior Publication Data

US 2017/0062891 A1 Mar. 2, 2017

(51) Int. Cl.

| | |
|---|---|
| ***H01P 1/203*** | (2006.01) |
| ***H01P 3/08*** | (2006.01) |
| ***H01P 1/201*** | (2006.01) |

(52) U.S. Cl.

CPC ..... *H01P 1/203* (2013.01); *H01P 1/201* (2013.01); *H01P 1/2016* (2013.01); *H01P 1/2039* (2013.01); *H01P 1/20381* (2013.01); *H01P 3/08* (2013.01); *H01P 3/081* (2013.01)

(58) Field of Classification Search

CPC ..... H01P 1/20381; H01P 1/203; H01P 3/08
USPC ..... 333/176, 204, 238, 172, 174, 175, 246
See application file for complete search history.

(56) References Cited

U.S. PATENT DOCUMENTS

| | | | | |
|---|---|---|---|---|
| 4,101,896 | A | 7/1978 | Ikrath et al. | |
| 7,088,299 | B2 | 8/2006 | Siegler et al. | |
| 8,310,398 | B2 | 11/2012 | Deng et al. | |
| 2005/0242905 | A1* | 11/2005 | Inoue | H01P 1/2039 333/204 |
| 2013/0002373 | A1* | 1/2013 | Robert | H01P 1/20336 333/204 |
| 2013/0307640 | A1* | 11/2013 | Wada | H01P 1/20381 333/134 |

FOREIGN PATENT DOCUMENTS

| | | |
|---|---|---|
| CN | 101714877 | 5/2010 |
| CN | 202550037 | 11/2012 |
| CN | 202712386 | 1/2013 |

OTHER PUBLICATIONS

Greer, "Stretching the Limit of Embedded Antenna Design", Wireless Design Magazine,www.skycross.com, Feb. 27, 2002, 12 pages.
Guo, "UWB Bandpass Filter with Quad-notched Bands Using Arrow-shaped Resonators", Microwave and Optical Technology Letters, vol. 57, No. 4, Apr. 2015, pp. 959-963.
Shaman et al., "Ultra-Wideband (UWB) Bandpass Filter . . . Band Notch Structures", IEEE Microwave and Wireless Components Letters, vol. 17, No. 3, Mar. 2007, pp. 193-195.

* cited by examiner

*Primary Examiner* — Stephen E Jones
*Assistant Examiner* — Rakesh Patel
(74) *Attorney, Agent, or Firm* — Andrew M. Calderon; Roberts Mlotkowski Safran Cole & Calderon, P.C.

(57) ABSTRACT

A notch filter includes a dielectric substrate; and a microstrip transmission line provided on the dielectric substrate and having an arrow-shaped embedded open-circuited stub.

20 Claims, 5 Drawing Sheets

NOTCH FILTER WITH ARROW-SHAPED EMBEDDED OPEN-CIRCUITED STUB

FIELD OF THE INVENTION

The invention relates to notch filters, and more particularly, to notch filters with an arrow-shaped embedded open-circuited stub.

BACKGROUND OF THE INVENTION

Notch filters, also commonly known as band-stop or band-rejection filters, reject a particular band of frequencies. Notch filters are also known as band elimination filters since they eliminate frequencies. The characteristics of a notch filter are essentially the inverse of the characteristics of a band pass filter. A notch filter has two cut-off frequencies (i.e. lower and upper cut-off frequencies) unlike high pass and low pass filters. The notch filter has two pass bands and one stop band. The notch filter passes signals above and below a determined range of frequencies (stop-band) and attenuates frequencies in between the cut-off frequencies.

Signal impurities naturally occur in radio frequency transmission technologies. These signal impurities, also known as spurious emissions, spurious harmonics, spurious signals, parasitic emissions, etc. are attenuated to reduce the effect on the transmission of corresponding data. The more spurious harmonics that are present in a frequency band, the fewer frequencies are available for use, e.g., for data transmission, cellular applications, radio transmission application, etc.

One technique to remove or attenuate spurious harmonics is to design wide band antennas to have narrow rejection bands. Alternatively, band-pass filters (BPFs) can be designed with single or multi narrow rejection bands. In general, this can be achieved by adding transmission line elements, such as conventional open-circuited stubs, whose electrical length is a quarter wavelength at the desired center frequency of the notched band. The characteristic impedance of the open-circuited stub is determined by the width of the structure.

The bandwidth of the notched band is directly proportional to the width of the open circuited stubs. Therefore, the physical width of the open circuited stub W becomes very small and difficult to fabricate, using conventional low cost printed circuit-board (PCB) technology, when narrow bandwidth is required. In addition, this technique increases the overall size of the design circuit board. To overcome these problems and to achieve a narrow notched band with realizable physical dimensions and small circuit size, spur lines and embedded open-circuited stubs can be implemented instead of conventional open-circuited stubs. The even and odd modes characteristic impedances of the spur line and embedded open-circuited stub are determined by the width and the gap which can be used to control the bandwidth of the notch.

Since spur lines and embedded open-circuited stubs are embedded into other components such as input and output feed lines, a notch can be generated without increasing the size of the circuit board. On the other hand, embedded open-circuited stub makes it possible to realize very high impedance. Hence, a very narrow rejection band can be achieved. However, the conventional open-circuited stub, spur line, and embedded open-circuited stub, whose electrical length is about a quarter wavelength long at the desired center frequency, have their spurious second harmonic at three times the center frequency of the notched band due to their distributed behavior. Since ultra-wide band (UWB) radio signals can cover a very wide band of frequency, i.e., from 3.1 gigahertz (GHz) to 10.6 GHz, the second harmonic might appear within the UWB allocated spectrum. For example, for WiMAX applications operating at the 3.5 GHz, the second harmonic when using conventional distributed components can appear at or below 10.5 GHz.

SUMMARY OF THE INVENTION

In an aspect of the invention, a notch filter includes a dielectric substrate; and a microstrip transmission line provided on the dielectric substrate and having an arrow-shaped embedded open-circuited stub.

In an aspect of the invention, a notch filter includes a dielectric substrate; and a microstrip transmission line provided on the dielectric substrate and having an arrow-shaped embedded open-circuited stub etched through the microstrip transmission line. The arrow-shaped embedded open-circuited stub exposes the underlying dielectric substrate In an aspect of the invention, microstrip transmission line includes an arrow-shaped embedded open-circuited stub including a plurality of perimeter legs that define the arrow-shaped embedded open-circuited stub.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION OF THE INVENTION

The invention relates to notch filters, and more particularly, to notch filters with an arrow-shaped embedded open-circuited stub. In accordance with aspects of the present invention, a notch filter with an arrow-shaped embedded open-circuited stub increases the distance between spurious harmonics in a given frequency band, and therefore increases the available frequencies for use. Increasing the distance between spurious harmonics in a given frequency band is particularly advantageous in ultra-wide band (UWB) environments, e.g., wireless communication environments, since wider bands potentially have more spurious harmonics than narrower bands.

In accordance with aspects of the present invention, a notch filter with an arrow-shaped embedded open-circuited stub increases the distance between spurious harmonics from a distance of three times of a center frequency to six times of a center frequency. As a result of the increased distance between spurious harmonics, fewer signal impurities exist in a frequency band, and more frequencies can be used, e.g., for data transmission, wireless communication, etc. As described herein, the nature of the arrow-shaped embedded open-circuited stub creates stepped impedance during transmission of data via the notch filter. This stepped impedance, in turn, increases the distance between the spurious harmonics.

Figure 1A:
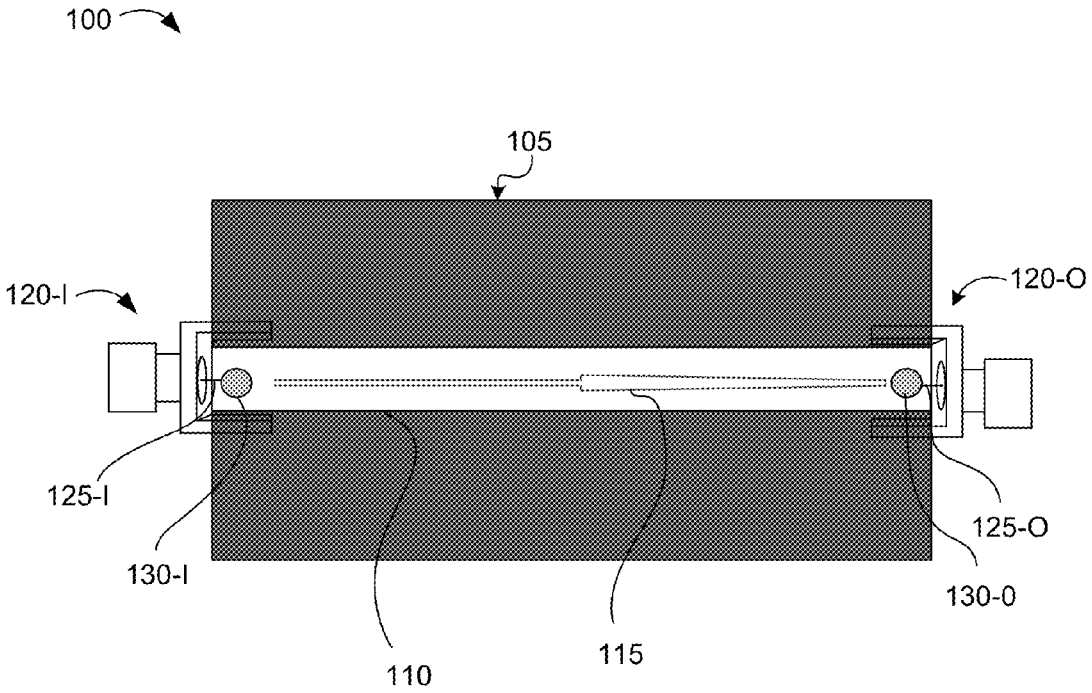
FIG. 1A shows a top view of a notch filter in accordance with aspects of the present invention.

FIG. 1A shows a top view of a notch filter in accordance with aspects of the present invention. As shown in FIG. 1A, a notch filter 100 includes a dielectric substrate 105, a microstrip transmission line 110, an arrow-shaped open-circuited stub 115, an input connection 120-I, and an output connection 120-O. The dielectric substrate 105 may be constructed from one more dielectric materials, such as glass microfiber polytetrafluoroethylene (PTFE) composites and/or other dielectric materials. In embodiments, the dielectric substrate 105 may have an effective dielectric constant of approximately 2.2, although the dielectric constant may differ for various embodiments. In some embodiments, the dielectric substrate 105 may have a thickness of approximately 1.27 millimeters (mm) to approximately 1.585 millimeters, although the thickness may differ for various embodiments. The microstrip transmission line 110 may have a thickness of approximately 0.017 mm, although the thickness may differ for various embodiments.

The microstrip transmission line 110 may include a copper, a copper alloy, and/or other conductive material(s). In embodiments, the microstrip transmission line 110 may have a resistance of 50 ohms, although microstrip transmission line 110 may have a different resistance. The microstrip transmission line 110 is provided on a first side, e.g., a top side, of the dielectric substrate 105. A ground plane conductor is provided on a second side, e.g., an underside, of the dielectric substrate 105. The arrow-shaped open-circuited stub 115 may be formed by etching or removing the microstrip transmission line 110 in the shape of an arrow. For example, the material of the microstrip transmission line 110 is etched or removed, e.g., using laser ablation or chemical etching such as reactive ion etching (RIE), to expose the top side of the underlying dielectric material of the dielectric substrate 105.

As further shown in FIG. 1A, an input connection 120-I includes an input terminal 125-I which is connected to the microstrip transmission line 110 via an input connection 130-I, which may be a solder connection. The input connection 120-I may include any type of connector, such as a coaxial connector, an SMA connector, or the like. An output connection 120-O includes an output terminal 125-O which is connected to the microstrip transmission line 110 via an output connection 130-O, which may be a solder connection. The output connection 120-O may include any type of connector such as a coaxial connector, a SubMiniature version A (SMA) connector, or the like. The input connection 120-I connects to a transmitting device whereby data is transmitted via the microstrip transmission line 110 and to a receiving device via output connection 120-O.

Figure 1B:
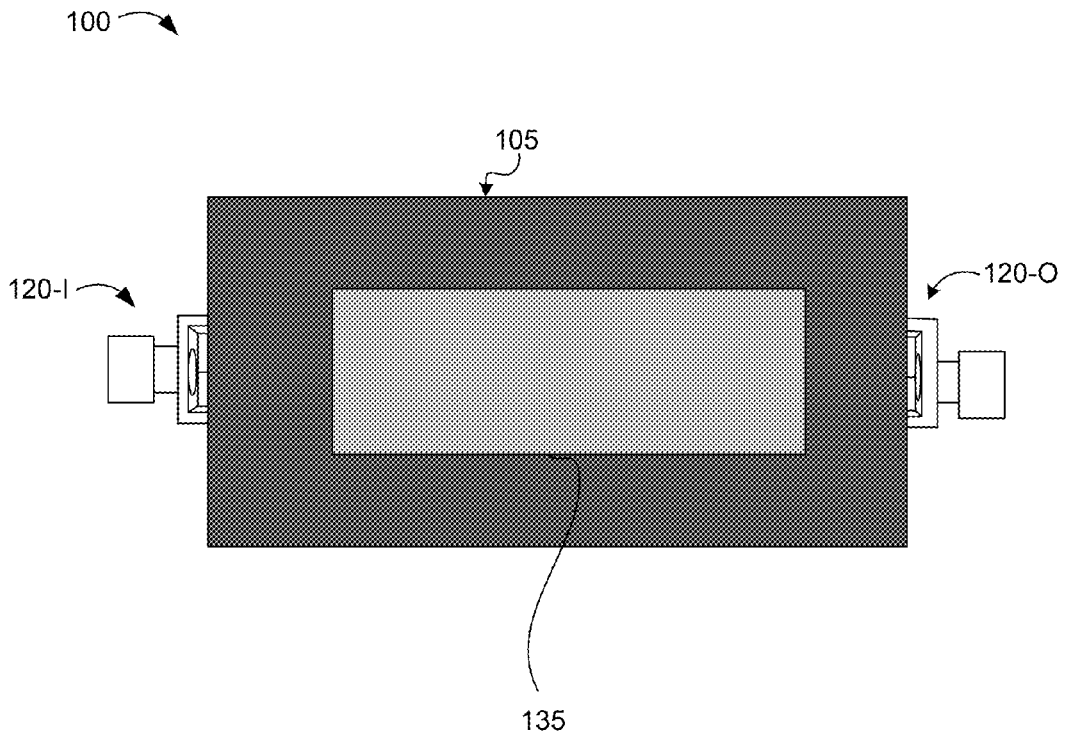
FIG. 1B shows a bottom view of the notch filter in accordance with aspects of the present invention.

As shown in FIG. 1A, the microstrip transmission line 110 is mounted on a first surface, e.g., a top surface, of the dielectric substrate 105. One end of the microstrip transmission line 110 is connected to the input connection 120-I and the second end is connected to the output connection 120-O. A ground plane conductor is placed on a second surface, e.g., a bottom surface or underside, of the dielectric substrate 105 as shown in FIG. 1B. As described herein, the arrow-shaped open-circuited stub 115 is etched in microstrip transmission line 110, e.g., via laser etching, chemical etching, and/or other etching process. The electrical length of the embedded arrow-shaped open-circuited stub 115 is approximately a quarter wavelength at the center frequency of the notched band. As described here, when data is transmitted via the notch filter 100, e.g., from the input to the output, the arrow-shaped open-circuited stub 115 creates a stepped impedance which, in turn, increases the distance between spurious harmonics. The microstrip layout of the notch filter 100 constructed in accordance with aspects of the present invention is symmetric with respect to the y-axis.

FIG. 1B shows a bottom view of a notch filter in accordance with aspects of the present invention. As shown in FIG. 1B, a second side of the dielectric substrate 105, e.g., a bottom side or underside, includes a ground plane 135. The ground plane 135 may be a single flat surface. Alternatively, the ground plane 135 may differ in size and shape than shown in FIG. 1B. In embodiments, the dielectric substrate 105 may include multiple ground planes 135 of various shapes and sizes.

Figure 2:
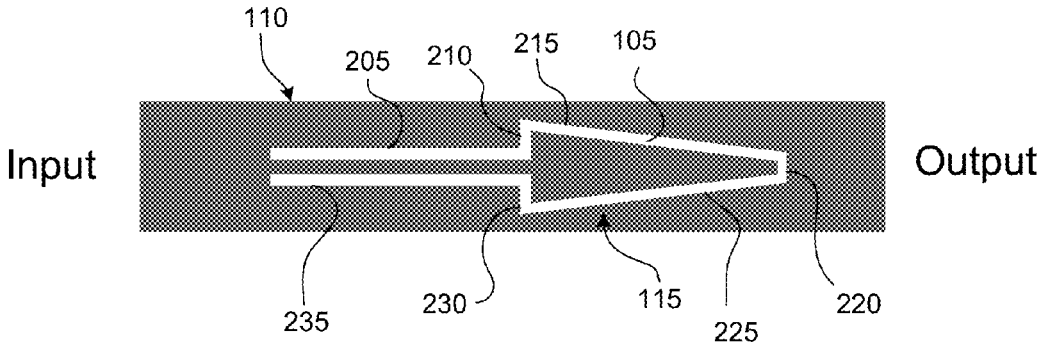
FIG. 2 shows a top view of a microstrip transmission line with an arrow-shaped embedded open-circuited stub in accordance with aspects of the present invention.

FIG. 2 shows a top view of the microstrip transmission line 110 in accordance with aspects of the present invention. As shown in FIG. 2, the microstrip transmission line 110 is etched in the shape of an arrow to form the arrow-shaped open-circuited stub 115, thereby exposing the underlying dielectric substrate 105. As further shown in FIG. 2, the arrow-shaped open-circuited stub 115 includes seven perimeter legs, e.g., legs 205, 210, 215, 220, 225, 230, and 235. The perimeter legs expose the dielectric substrate 105 from the microstrip transmission line 110. Legs 205 and 235 are substantially parallel to each other. Legs 215 and 225 are angled legs that substantially converge to form an arrow shape, and legs 210 and 230 define a step that correspond to the inclination of the angles of legs 215 and 225. Leg 220 is a vertex point where legs 215 and 225 generally converge.

Figure 3:
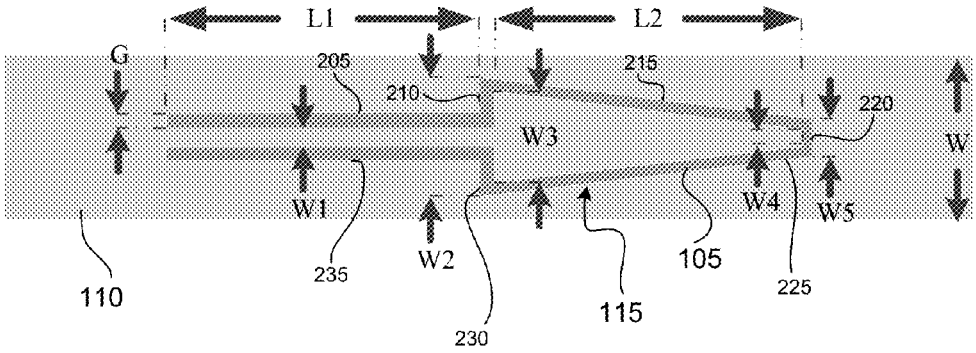
FIG. 3 shows dimensions of an arrow-shaped embedded open-circuited stub in accordance with aspects of the present invention.

FIG. 3 shows a top view of the microstrip transmission line 110 and example dimensions of components of the notch filter in accordance with aspects of the present invention. As shown in FIG. 3, the arrow-shaped open-circuited stub 115 includes the lengths L1 and L2, widths W1, W2, W3, W4, W5, and a gap G. The dielectric substrate 105 includes a width W. As shown in FIG. 3, the gap G is a thickness of perimeter legs defining the arrow-shaped open-circuited stub 115. The length L1 is a length of a portion of the arrow-shaped open-circuited stub 115 having parallel perimeter legs, e.g., legs 205 and 235. The length L2 is a horizontal length along an x-axis of a portion of the arrow-shaped open-circuited stub 115 having a stepped arrow shape, e.g., a horizontal length along an x-axis of legs 215 and 225. The width W1 defines a distance between parallel perimeter legs of the arrow-shaped open-circuited stub 115, e.g., legs 205 and 235. The width W2 defines the width of a step that forms the arrow shape of the arrow-shaped open-circuited stub 115, e.g., a distance between an outermost edge of leg 210 and an outermost edge of leg 230. The width W3 is based on the gap G and the width W2. The width W5 defines a width of a vertex point of the arrow-shaped open-circuited stub 115, e.g., the width of leg 220. W4 is based on the gap G and the width W5.

The dimensions of lengths L1 and L2 can be selected based on a desired center frequency of a notched band. The dimension of gap G and width W5 can be selected based on a desired width of the resonant frequency of the first spurious harmonic, e.g., the center frequency. Also, the dimensions of gap G and width W5 can be selected to control the bandwidth of the notch. The difference between W1 and W3 causes a stepped impedance which in turn increases the distance between spurious harmonics in a frequency band. The gap G also affects the dimension W1, e.g., a larger gap would reduce W1. Widths W4 and W5 are also based on the gap G. A larger gap G would reduce the width of the resonant frequency of the first spurious harmonic, but would reduce the distance between W1 and W3, and the increases the distance between spurious harmonics. Thus, the gap G can be selected to balance the benefits of a reduced resonant frequency width with the benefits of the distance between spurious harmonics.

By way of non-limiting, illustrative example, approximate measurements of the dimensions include: W=5.0 mm, W1=0.2 mm, W2=3.4 mm, W3=2.6 mm, W4=0.2 mm, W5=1.0 mm, G=0.4 mm, L1=17.7 mm, and L2=27.8 mm. The example dimensions are provided for a particular application in which the notch filter 100 generates a notch with a very narrow bandwidth at a center frequency of about 1.0 GHz and a distance between the center frequency and 6 times the center frequency, e.g., 6 GHz in this example.

It should be noted that the notch filter 100 is not limited to operate at this particular frequency, and the example dimensions are for illustrative purposes only. The notch filter 100 can be modified to operate at any desired operating frequency within the limitations of the dielectric substrate 105. In addition, the number of the embedded open-circuited resonator and the materials used for the dielectric substrate 105 or the microstrip transmission lines 110 can also be modified to meet specific requirements. Since the notch filter 100 includes only one embedded arrow-shaped open circuited stub 115, the notch filter 100 behaves as a single pole filter. The number of the embedded arrow-shaped open-circuited stubs 115 defines the number of poles the notch filter 100 has. Thus, the notch filter 100 is not limited to the layout shown in which only one arrow-shaped open-circuited stub 115 is provided.

Figure 4:
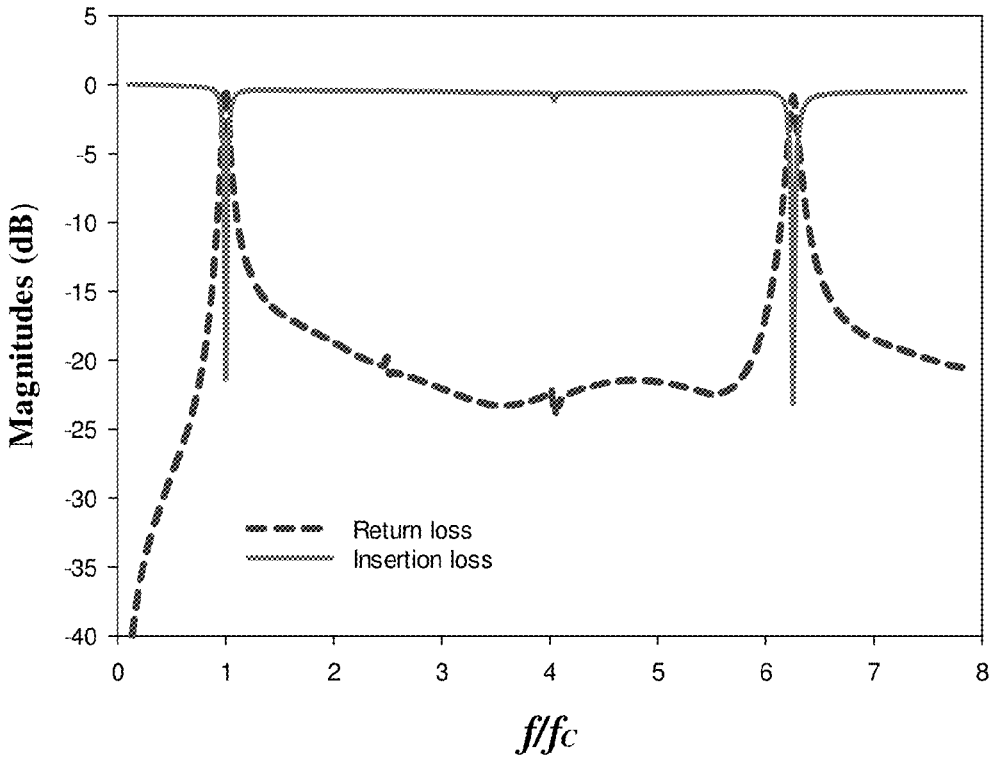
FIG. 4 shows a graph of rejection levels using the notch filter in accordance with aspects of the present invention.

FIG. 4 shows a graph of rejection levels using the notch filter 100 in accordance with aspects of the present invention. As shown in FIG. 4, a narrow notched band is obtained at a frequency of approximately 1 unit with a level of rejection of approximately −20 dB. As further shown in FIG. 4, the second harmonic appears at more than six times the center frequency of the notched band, e.g., at approximately 6 units, unlike similar existing resonators such as conventional open-circuited stub, spur-line resonator, and embedded open stub with uniform shape whose second spurious harmonic appears at only three times the center frequency. The advantages of shifting the undesired second spurious harmonic up to more than six times (6×) the center frequency of the notch in addition to the narrow rejection band make the notch filter 100 ideal for many applications, such as UWB applications, e.g., wireless communication systems and/or other systems in which a wide band of frequencies are used. For example, as a result of the increased distance between spurious harmonics, fewer signal impurities exist in a frequency band, and more frequencies can be used, e.g., for data transmission, wireless communication, etc.

Figure 5:
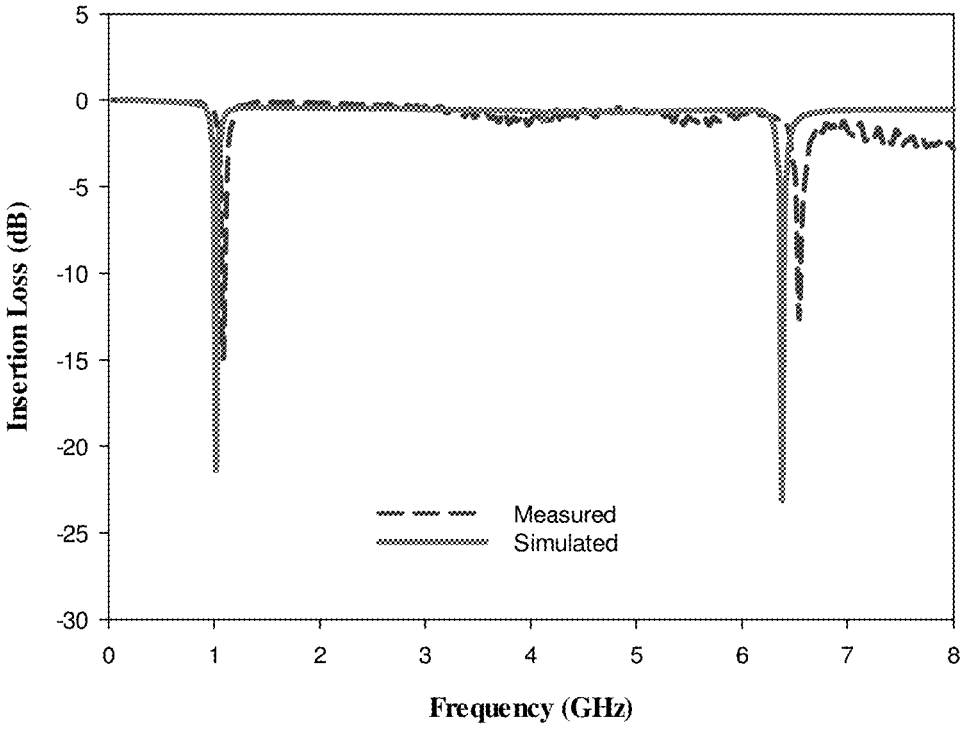
FIG. 5 shows a graph comparing measured insertion loss with simulated insertion loss for the notch filter in accordance with aspects of the present invention.

FIG. 5 shows a graph comparing measured insertion loss with simulated insertion loss for the notch filter 100. The simulated insertion loss data can be obtained, for example, using any variety of known electromagnetic (EM) simulation techniques. As shown in FIG. 5, the measured insertion loss has a rejection level of more than −15 decibels (dB) at the center frequency of the notched band compared to a simulated frequency of approximately −20 dB at the center frequency.

The foregoing examples have been provided for the purpose of explanation and should not be construed as limiting the present invention. While the present invention has been described with reference to an exemplary embodiment, Changes may be made, within the purview of the appended claims, without departing from the scope and spirit of the present invention in its aspects. Also, although the present invention has been described herein with reference to particular materials and embodiments, the present invention is not intended to be limited to the particulars disclosed herein; rather, the present invention extends to all functionally equivalent structures, methods and uses, such as are within the scope of the appended claims.

What is claimed:

1. A notch filter comprising:

a dielectric substrate; and a microstrip transmission line provided on the dielectric substrate and having a non-connective gap forming an arrow-shaped embedded open-circuited stub.

2. The notch filter of claim 1, wherein the arrow-shaped embedded open-circuited stub includes seven perimeter legs that define the arrow-shaped embedded open-circuited stub.

3. The notch filter of claim 2, wherein the arrow-shaped embedded open-circuited stub includes a first length, a second length, a first width, and a second width, wherein:

the first length defines a length of a portion of arrow-shaped embedded open-circuited stub having two parallel perimeter legs of the seven perimeter legs, the second length defines a horizontal length along an x-axis of two angled perimeter legs of the seven perimeter legs that define an arrow shape of the arrow-shaped embedded open-circuited stub, the non-connective gap defines a thickness of the seven perimeter legs, the first width defines a distance between the two parallel perimeter legs, and the second width defines a width of a step that forms the arrow shape.

4. The notch filter of claim 3, wherein the first length is approximately 17.7 millimeters (mm), the second length is approximately 27.8 mm, the first width is approximately 0.2 mm, the second width is approximately 3.4 mm, and the non-connective gap is approximately 0.4 mm.

5. The notch filter of claim 1, wherein the arrow-shaped embedded open-circuited stub causes a stepped impedance on a signal transmitted via the microstrip transmission line.

6. The notch filter of claim 5, wherein the stepped impedance causes a distance between a second spurious harmonic in the signal to be shifted to approximately six times a center frequency in which a first spurious harmonic is present.

7. The notch filter of claim 1, wherein a thickness of the microstrip transmission line is approximately 0.017 mm and the thickness of the dielectric substrate is approximately 1.27 mm to approximately 1.585 mm.

8. The notch filter of claim 1, further comprising a ground plane conductor on an opposite side of the dielectric substrate as part of the microstrip transmission line.

9. The notch filter of claim 1, wherein a conductive material of the microstrip transmission line surrounds the arrow-shaped embedded open-circuited stub.

10. A notch filter comprising:

a dielectric substrate; and a microstrip transmission line provided on the dielectric substrate and having a non-connective gap forming an arrow-shaped embedded open-circuited stub etched through the microstrip transmission line, wherein the arrow-shaped embedded open-circuited stub exposes the underlying dielectric substrate.

11. The notch filter of claim 10, wherein the arrow-shaped embedded open-circuited stub includes seven perimeter legs that define the arrow-shaped embedded open-circuited stub.

12. The notch filter of claim 11, wherein the arrow-shaped embedded open-circuited stub includes a first length, a second length, a first width, and a second width, wherein:

the first length defines a length of a portion of arrow-shaped embedded open-circuited stub having two parallel perimeter legs of the seven perimeter legs, the second length defines a horizontal length along an x-axis of two angled perimeter legs of the seven perimeter legs that define an arrow shape of the arrow-shaped embedded open-circuited stub, the non-connective gap defines a thickness of the seven perimeter legs, the first width defines a distance between the two parallel perimeter legs, and the second width defines a width of a step that forms the arrow shape.

13. The notch filter of claim 12, wherein the first length is approximately 17.7 millimeters (mm), the second length is approximately 27.8 mm, the first width is approximately 0.2 mm, the second width is approximately 3.4 mm, and the non-connective gap is approximately 0.4 mm.

14. The notch filter of claim 10, wherein the arrow-shaped embedded open-circuited stub causes a stepped impedance on a signal transmitted via the microstrip transmission line.

15. The notch filter of claim 14, wherein the stepped impedance causes a distance between a second spurious harmonic in the signal to be shifted to approximately six times a center frequency in which a first spurious harmonic is present.

16. The notch filter of claim 10, further comprising a ground plane conductor on an opposite side of the dielectric substrate as part of the microstrip transmission line.

17. The notch filter of claim 10, wherein a thickness of the microstrip transmission line is approximately 0.017 mm and the thickness of the dielectric substrate is approximately 1.27 mm to approximately 1.585 mm.

18. A microstrip transmission line comprising a non-connective gap forming an arrow-shaped embedded open-circuited stub including a plurality of perimeter legs that define the arrow-shaped embedded open-circuited stub.

19. The microstrip transmission line of claim 18, wherein the arrow-shaped embedded open-circuited stub includes exactly seven perimeter legs, and further includes a first length, a second length, a first width, and a second width, wherein:

the first length defines a length of a portion of arrow-shaped embedded open-circuited stub having two parallel perimeter legs of the seven perimeter legs, the second length defines a horizontal length along an x-axis of two angled perimeter legs of the seven perimeter legs that define an arrow shape of the arrow-shaped embedded open-circuited stub, the non-connective gap defines a thickness of the seven perimeter legs, the first width defines a distance between the two parallel perimeter legs, and the second width defines a width of a step that forms the arrow shape.

20. The microstrip transmission line of claim 19, wherein the first length is approximately 17.7 millimeters (mm), the second length is approximately 27.8 mm, the first width is approximately 0.2 mm, the second width is approximately 3.4 mm, the non-connective gap is approximately 0.4 mm, and a thickness of the microstrip transmission line is approximately 0.017 mm.

* * * * *